US007938756B2

(12) United States Patent
Rodetsky et al.

(10) Patent No.: US 7,938,756 B2
(45) Date of Patent: May 10, 2011

(54) POWERED MOBILE LIFTING, GAIT TRAINING AND OMNIDIRECTIONAL ROLLING APPARATUS AND METHOD

(76) Inventors: Roy Rodetsky, Brampton (CA); Olga Rodetsky, Brampton (CA)

( * ) Notice: Subject to any disclaimer, the term of this patent is extended or adjusted under 35 U.S.C. 154(b) by 53 days.

(21) Appl. No.: 12/309,515

(22) PCT Filed: Feb. 10, 2007

(86) PCT No.: PCT/IB2007/050442

§ 371 (c)(1),
(2), (4) Date: Jan. 22, 2009

(87) PCT Pub. No.: WO2008/096210

PCT Pub. Date: Aug. 14, 2008

(65) Prior Publication Data

US 2009/0298653 A1 Dec. 3, 2009

(51) Int. Cl.
*A61H 3/00* (2006.01)
*A61H 3/04* (2006.01)
*A61G 7/053* (2006.01)

(52) U.S. Cl. ..... 482/69; 482/68; 5/81.1 R; 135/67

(58) Field of Classification Search ..... 482/66–69; 601/5, 23; 280/200; 602/23; 135/67; 5/81.1 R, 5/83.1, 86.1, 85.1, 87.1, 89.1; 297/5
See application file for complete search history.

(56) References Cited

U.S. PATENT DOCUMENTS 2,792,052 A * 5/1957 Johannesen ..... 297/5
5,365,621 A * 11/1994 Blain ..... 5/87.1
5,502,851 A 4/1996 Costello
5,569,129 A * 10/1996 Seif-Naraghi et al. ..... 482/69
5,662,560 A 9/1997 Svendsen
5,695,432 A 12/1997 Soderlung
6,119,287 A * 9/2000 Phillips ..... 5/81.1 RP
6,273,844 B1 * 8/2001 Kelsey et al. ..... 482/54

(Continued)

FOREIGN PATENT DOCUMENTS

CA 2133622 A1 12/1995

(Continued)

OTHER PUBLICATIONS

Sado Lezernik et al, Automatic Gait-Pattern Adaptation Algorithms for Rehabilitation With a 4-DOF Robotic Orthosis, IEEE Transactions on Robotics and Automation, Jun. 2004, pp. 574-579, vol. 20, No. 3, Institute of Electrical and Electronics Engineers, USA ISA cited, ref, No D7.

(Continued)

*Primary Examiner* — Allana Lewin

(57) ABSTRACT

A powered mobile lifting, gait training and omnidirectional rolling apparatus is for personal use by persons with complete loss of motor function in lower limbs for assisted walking in an upright position in desired direction of indoor and outdoor. All operations including bringing the apparatus to a user, ingress, walking around and egress are performed by users without assistance of other persons. The apparatus lifts the user from a floor, wheelchair or elevated surface, its overall size enables passing through narrow passageways, and omnidirectional wheels provide top maneuverability. Rotation of powered omnidirectional wheels is coordinated with motion of gait stimulation devices that drive user's feet, resulting in simulated walk. The apparatus comprises a rigid 'U'-shaped base integrating a powered lifting and supporting device, powered gait simulation devices, step length setup devices, powered omnidirectional wheels with brakes, retractable support mechanisms, control, monitoring, communication and recording means, a power supply block, and a harness.

15 Claims, 9 Drawing Sheets

U.S. PATENT DOCUMENTS

| | | | | |
|---|---|---|---|---|
| 6,513,824 | B2 | 2/2003 | DuBose | |
| 6,539,562 | B1 | 4/2003 | Bianca | |
| 6,578,594 | B1 | 6/2003 | Bowen | |
| 6,679,510 | B2 | 1/2004 | Perena | |
| 6,689,075 | B2 * | 2/2004 | West | 601/23 |
| 6,694,545 | B1 | 2/2004 | Renton | |
| 6,770,040 | B2 * | 8/2004 | Perner et al. | 601/5 |
| 6,821,233 | B1 * | 11/2004 | Colombo et al. | 482/54 |
| 7,021,427 | B2 | 4/2006 | Skovgaard | |
| 7,601,104 | B2 * | 10/2009 | Agrawal et al. | 482/69 |
| 2002/0026130 | A1 * | 2/2002 | West | 601/23 |
| 2004/0116839 | A1 | 6/2004 | Sarkodie-Gyan | |
| 2004/0143198 | A1 * | 7/2004 | West | 601/5 |
| 2005/0101448 | A1 * | 5/2005 | He et al. | 482/54 |
| 2006/0260621 | A1 * | 11/2006 | Agrawal et al. | 128/845 |

FOREIGN PATENT DOCUMENTS

| | | | |
|---|---|---|---|
| CA | 2381887 | A1 | 3/2001 |
| CA | 2302061 | A1 * | 9/2001 |
| CA | 2419907 | A1 | 2/2002 |
| CA | 2561140 | A1 | 8/2005 |
| GB | 2291362 | A | 1/1996 |

OTHER PUBLICATIONS

Robert Reiner et al, Patient-Cooperative Strategies for Robot-Aided Treadmill Trining: First Experimental Results, IEEE Transactions on Neural Systems and Rehabilitation Engineering, Sep. 2005, pp. 380-386, vol. 13, No. 3, Institute of Electrical and Electronics Engineers, USA ISA cited, ref. No D8.

* cited by examiner

POWERED MOBILE LIFTING, GAIT TRAINING AND OMNIDIRECTIONAL ROLLING APPARATUS AND METHOD

TECHNICAL FIELD

The present invention relates to devices which provide therapeutic rehabilitation exercising to patients with spinal cord injuries and other lower body neurological impairments. Also, the invention relates to devices that are designated for personal use and which provide mobility to persons with disabilities.

The present invention enables persons with complete loss of motor function in lower limbs to walk in desired direction in an upright position without assistance of other people. The powered mobile lifting, gait training and omnidirectional rolling apparatus which is a subject of the present invention and which further is also referred to as "the apparatus", offers its users a high level of mobility and complete independency in its operation. Also, the apparatus enables monitoring and recording physiologic data of users.

BACKGROUND ART

Prior art devices can only perform separate functions delivered by the powered mobile lifting, gait training and omnidirectional rolling apparatus. Powered gait orthoses that provide gait exercising for people with complete loss of motor function in lower limbs are big stationary devices. They are usually installed in clinics or rehabilitation centres and require excessive preparation for use and direct assistance of trained personnel during exercising. Patients can only exercise gait training with no general mobility provided. Also, to use such devices, patients have to visit clinics or rehabilitation centres.

Second type of prior art devices related to the present invention, are walkers which provide gait exercising and mobility to persons with disabilities. However, these devices can be used only by those who can actually walk.

Third type of prior art devices relevant to the present invention, are wheelchairs. However, they are conveyance devices which do not provide users with an opportunity to exercise gait training in an upright position.

DISCLOSURE OF INVENTION

Technical Problem

The present invention seeks to overcome the drawbacks and disadvantages of identified above prior art devices, by creation of a safe and compact apparatus for personal use, which would enable persons with complete loss of motor function in lower limbs to exercise power assisted gait training combined with general mobility of the apparatus in the way that simulates walking pattern of a healthy person, indoor or outdoor, without assistance of other persons.

Technical Solution

The present invention provides a powered mobile lifting, gait training and omnidirectional rolling apparatus which integrates devices, mechanisms and systems installed on the rigid "U"-shaped base with a vertical framework, and which are further disclosed.

For the powered mobile lifting, gait training and omnidirectional rolling apparatus described above, a powered lifting and supporting device is designated to load and unload a user, and to keep him or her in a suspended upright position during exercising, by means of connecting and securely locking a user suspension harness. The user suspension harness is configured for securing about the user's body by means of thigh wraps and a wide lumbar belt to evenly redistribute pressure from body weight and thus, to safely support and suspend the user's body. Sensors for acquiring patient's physiologic data are located on the user suspension harness. They have common output connector which connects to mating connector on the powered lifting and supporting device, and they are attached to user's body when the harness is put on. The apparatus is capable to lift users from a floor, elevated surfaces and wheelchairs. The powered lifting and supporting device comprises a height adjustable tubular lifting frame shaped in the way to accommodate the user. The lower ends of the lifting frame are pivotally connected to the base. The lifting frame tilts back into position ready for user lifting operation and then returns back into its vertical (home) position by means of two linear actuators. The top ends of the lifting frame are equipped with pendulous harness locking mechanisms. In case of emergency unlocking of the harness or self-disengaging of any side of the harness, all motion related functions of the apparatus are blocked and breaks are engaged. The lifting frame is equipped with left and right control pads combined with hand grips.

For the apparatus described above, two powered gait simulation devices are created to enable power assisted gait training by driving user's feet. The gait simulation devices provide coordinated horizontal, vertical and tilting motion of user's feet thus, ensuring that trajectories and sequence of motion of feet reproduce natural walking pattern. User's feet are fastened to and driven by the driving shoes which are elements of the powered gait simulation devices. The gait simulation devices provide partial, restricted by springs freedom of motion of user's feet about generally horizontal and vertical axes. Combined with flexible driving shoe soles, these features increase similarity with normal walking pattern and add comfort to users. The elevation of the driving shoes in their lowered position over a floor surface is set by adjusting strokes of the vertical motion actuators.

For the powered mobile lifting, gait training and omnidirectional rolling apparatus described above, desired step length is determined by two powered step length setup devices. Step length is preset by the user from a control panel located on the top panel.

For the apparatus described above, four powered omnidirectional wheels with electromechanical brakes provide mobility and maneuverability of the apparatus and its breaking. Rotation of omnidirectional wheels is coordinated with motion of gait simulation devices in the way that the apparatus simulates normal walking pattern as the user walks forward, backward or makes turns. When, due to capabilities of omnidirectional wheels, user moves sideways or turns around on a spot, the gait simulation devices bring user's feet into stand-by for walking position and slightly lift them over the floor surface.

For the powered mobile lifting, gait training and omnidirectional rolling apparatus described above, two powered retractable support mechanisms are introduced to provide stability of the apparatus and safety for users during lifting and unloading operations. Support legs of the mechanisms are elevated in their retracted position and reach a floor surface when extended.

For the apparatus described above, all motion control, patient monitoring, data recording, remote control and communication functions are provided by a computerized motion control and patient monitoring system.

For the powered mobile lifting, gait training and omnidirectional rolling apparatus described above, a remote control block is introduced to enable the user to bring the apparatus from a remote location out of user's sight and further to bring the apparatus into ready for lifting position. Also, the remote control block displays physiologic data of patients and serves as a communication device for a remote assistance. If necessary, the assistant can remotely take control over the apparatus.

For the apparatus described above, a portable rechargeable source of power supply and a charging system are employed.

For the powered mobile lifting, gait training and omnidirectional rolling apparatus described above, a vertical framework serves as a reinforcement structure, a safety barrier, a bearing structure for actuators of the powered lifting and supporting mechanism and a base for a top panel equipped with a control panel with a screen and a pivoting camera. The vertical framework provides users with a plurality of hand grips.

The present invention further provides a method of simulation of natural walking pattern by coordinating translation of the described above powered mobile lifting, gait training and omnidirectional rolling apparatus with motion of the described above gait simulation devices, and operation of the above apparatus.

The method includes providing a suspension harness which a user fits to his or her body and then attaches physiological data acquisition sensors.

The method further includes providing a powered mobile lifting, gait training and omnidirectional rolling apparatus and providing a remote control, monitoring and communication block for bringing the apparatus to a user and into ready for lifting position. At the ready for lifting position, the step length setup devices are set to maximum length of step, the powered gait simulation devices are in rear position, the powered lifting and supporting device is tilted back, the retractable support mechanisms are extended and omnidirectional wheel brakes are engaged.

The method further includes steps of fastening user's feet to driving shoes of the powered gait simulation devices, attaching the suspension harness to the right and left pendulous locking mechanisms of the powered lifting and supporting device and connecting a physiological data acquisition sensor connector to a mating connector installed on the powered lifting and supporting device.

The method further includes lifting the user into stand-by for walking position. To perform this operation, the user holds hand grips of the powered lifting and supporting device and calls lifting command using control pads. During lifting operation the powered lifting and supporting device returns into its home (vertical) position, the powered gait simulation devices move into position directly beneath harness suspension connection points, the step length setup devices reset to required step length, the retractable support mechanisms retract and omnidirectional wheel brakes disengage. At this point, the user is ready to exercise gait training in the upright suspended position, using hand grips of the powered lifting and supporting device as additional supports.

The method further includes steps related to rotation of omnidirectional wheels coordinated with motion of the powered gait simulation devices. From a stand-by position, motion forward begins with elevating the first driving shoe (right or left preset by the user from the control panel) and then translating it forward. Simultaneously, second driving shoe starts translating backward and omnidirectional wheels start coordinated rotation to provide natural displacement of user's body and to keep the second driving shoe stationary relatively to a floor. When step length comes closer to a preset value, the first driving shoe begins tilting in accordance to natural walking pattern. Simultaneously, the second driving shoe begins tilting and elevating according to natural walking pattern. The front portion of the second driving shoe enters into contact with a floor surface and starts bending in metatarsophalangeal and phalangeal regions of a foot due to flexibility of the driving shoe sole in order to provide natural walking pattern. Starting phase ends when the first driving shoe is in fully advanced, elevated and tilted position and the second driving shoe is in maximum rear tilted position and keeps elevating. From this point, another step begins. Second driving shoe continues elevating to a maximum position and starts moving forward. Tilting of the second driving shoe decreases in course of its advancement. The first driving shoe starts lowering down and moving backward at the same moment when second shoe starts advancing, and tilting of the first driving shoe also decreases in course of moving backward. As a result, user's legs move in opposite directions according to normal walking pattern. Coordinated rotation of omnidirectional wheels causes translation of the apparatus which provides natural displacement of user's body and keeps the first driving shoe stationary relatively to a floor. When step length comes closer to a preset value, the second driving shoe begins tilting in accordance to natural walking pattern.

Simultaneously, the first driving shoe begins tilting and elevating according to natural walking pattern. The front portion of the first driving shoe enters into contact with a floor surface and starts bending in metatarsophalangeal and phalangeal regions of a foot due to flexibility of the driving shoe sole in order to provide natural walking pattern. The step ends when the second driving shoe is in fully advanced, elevated and tilted position and the first driving shoe is in maximum rear tilted position and keeps elevating. At this point, another walking cycle begins, and so on. At a command to stop walking, the driving shoe that is moving forward, continues the sequence of advancing, lowering and moving backward, however, only to a point where the driving shoe reaches its stand-by for walking position. Simultaneously, the other driving shoe continues the sequence of moving backward, elevating, advancing and then lowering down when it reaches its stand-by for walking position. As a result, both user's feet come into stand-by for walking position in a natural walking manner. In case of backing the walking sequence is opposite to one described above. In case of turning while walking forward or backward, the walking sequences are the same as for moving forward or backing while the apparatus maneuvers. Omnidirectional wheels also enable users to move sideways or turn around on spot. In this case driving shoes first return into stand-by position and the apparatus comes to a complete stop. Then driving shoes elevate to prevent interference with a floor, after that sideways or turning-on-the-spot motion is performed.

The method further includes providing a user with means to control walking speed and direction of motion, with user interface elements located on the right and left control pads of the powered lifting and supporting device.

The method further yet includes steps related to user unloading operation, which are opposite to steps related to user lifting operation described above.

ADVANTAGEOUS EFFECTS

The described above powered mobile lifting, gait training and omnidirectional rolling apparatus overcomes the drawbacks and disadvantages of prior art devices. The present invention renders a great positive psychological effect to persons with complete loss of motor function in lower limbs by delivering them a sensation of walking around similarly to healthy people, and enabling them to use the described above apparatus any time indoor or outdoor without assistance of other people. Furthermore, users exercise gait training not as a separate therapeutical procedure but every time when they use the described above apparatus for mobility purposes. A gait training delivered by the described above powered mobile lifting, gait training and omnidirectional rolling apparatus renders a positive therapeutic effect by stimulating patient's locomotor system and improving blood circulation in the lower limbs. Also, the gait training in an upright position provided by the described above apparatus stimulates functions of abdominal organs of patients which is very important for paraplegics.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that the following brief description of the drawings, detailed description of the invention and the best mode contemplated are illustrative only and intended to provide further explanation without limiting the scope of the invention as claimed. It will also be understood by those skilled in the art that various changes may be made and equivalents may be substituted without departing from the scope of the invention. In addition, many modifications may be made to adapt a particular situation or material to the teachings of the invention without departing from its scope. Therefore, all changes and modifications that come within the spirit of the invention are desired to be protected.

BRIEF DESCRIPTION OF THE DRAWINGS

The accompanying drawings which are included to provide a further understanding of the invention and which are incorporated in and constitute a part of this specification, illustrate preferred embodiment(s) of the invention and together with the detail description serve to explain the principles of the invention. In the drawings.

DETAILED DESCRIPTION OF THE INVENTION AND BEST MODE CONTEMPLATED

Reference will now be made in detail to the preferred embodiment(s) of the invention illustrated in the accompanying drawings. Wherever possible, the same reference numbers will be used throughout the drawings to refer to the same or like parts. Fasteners and pluralities of fasteners that perform trivial functions from the point of view of a skilled artisan and if omitting them does not distort understanding of the invention, are removed from the illustrations for clarity, and instead of that a word "bolted" is used to indicate that elements of the embodiment(s) are connected or interconnected in such a way. It will nevertheless be understood that no limitation of the scope of the invention is thereby intended; such alterations and further modifications in the illustrated apparatus, and such further applications of the principles of the invention as illustrated therein being contemplated as would normally occur to one skilled in the art to which the invention relates.

Figure 1:
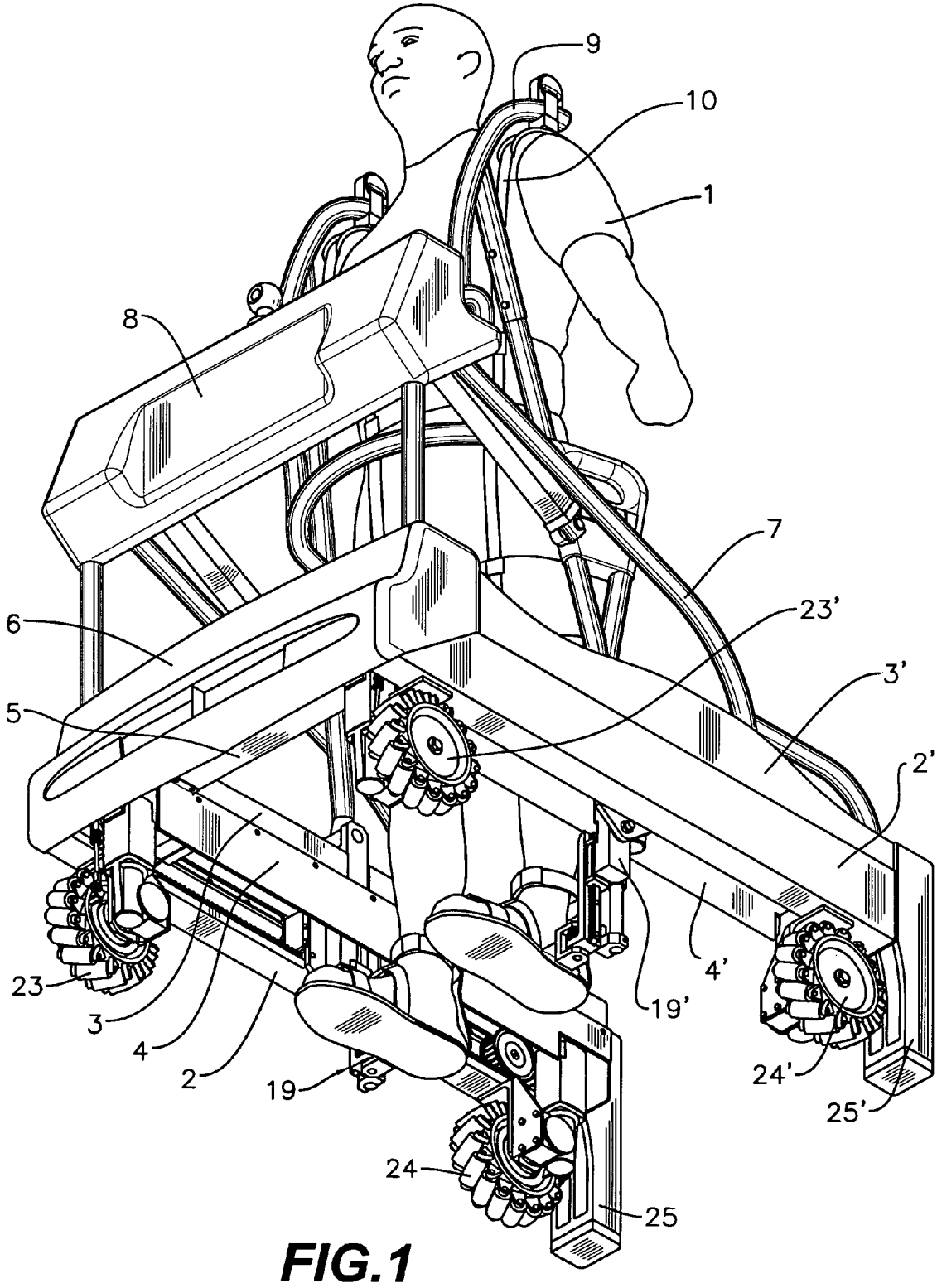
FIG. 1 is a perspective view of the powered mobile lifting, gait training and omnidirectional rolling apparatus according to the present invention, and it illustrates a general arrangement of the apparatus with a user in stand-by for walking position.
Figure 4:
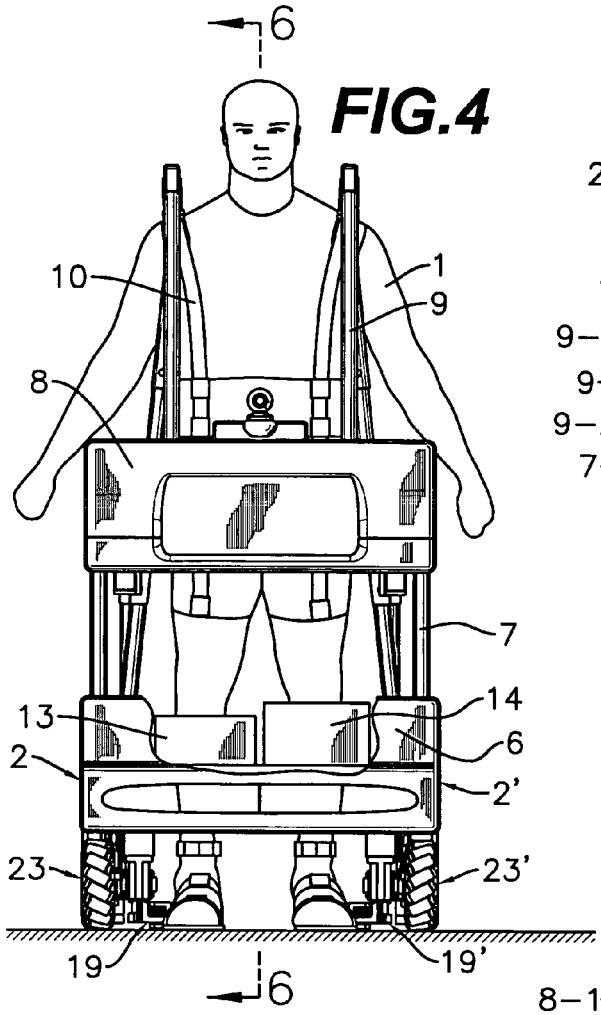
FIG. 4 is a front view of the structure of FIG. 1, and it illustrates a general arrangement of the apparatus and the arrangement of the power and control compartment shown with a partial sectional view.
Figure 5:
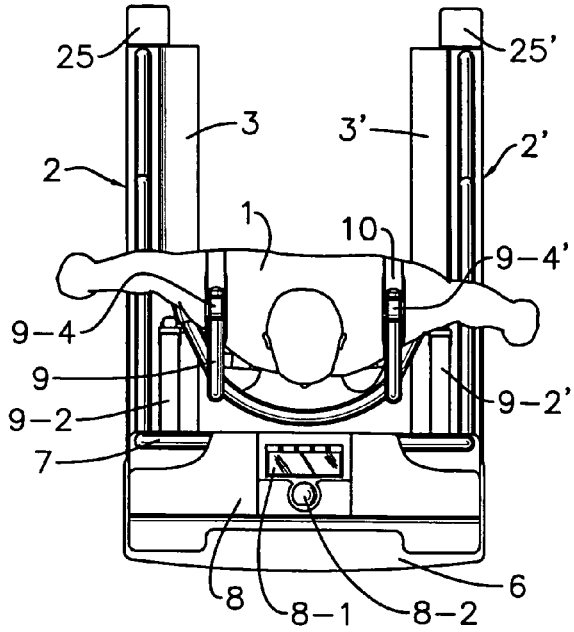
FIG. 5 is a top view of the structure of FIG. 1, and it illustrates a general arrangement of the apparatus and the arrangement of the top panel.

FIG. 1, FIG. 4 and FIG. 5 clearly illustrate that the arrangements of the right and left sides of the apparatus are identical but opposite (mirrored). Therefore, further illustrations will be given to the arrangement of the right carriage 2 only, to avoid unnecessary redundancy. To enhance understanding of the embodiment(s), the reference numbers of such elements on the left side of the apparatus are similar to those on the right side however, apostrophe added. For example, the right carriage is given the reference number 2 and the left carriage is given the reference number 2'.

Figure 15:
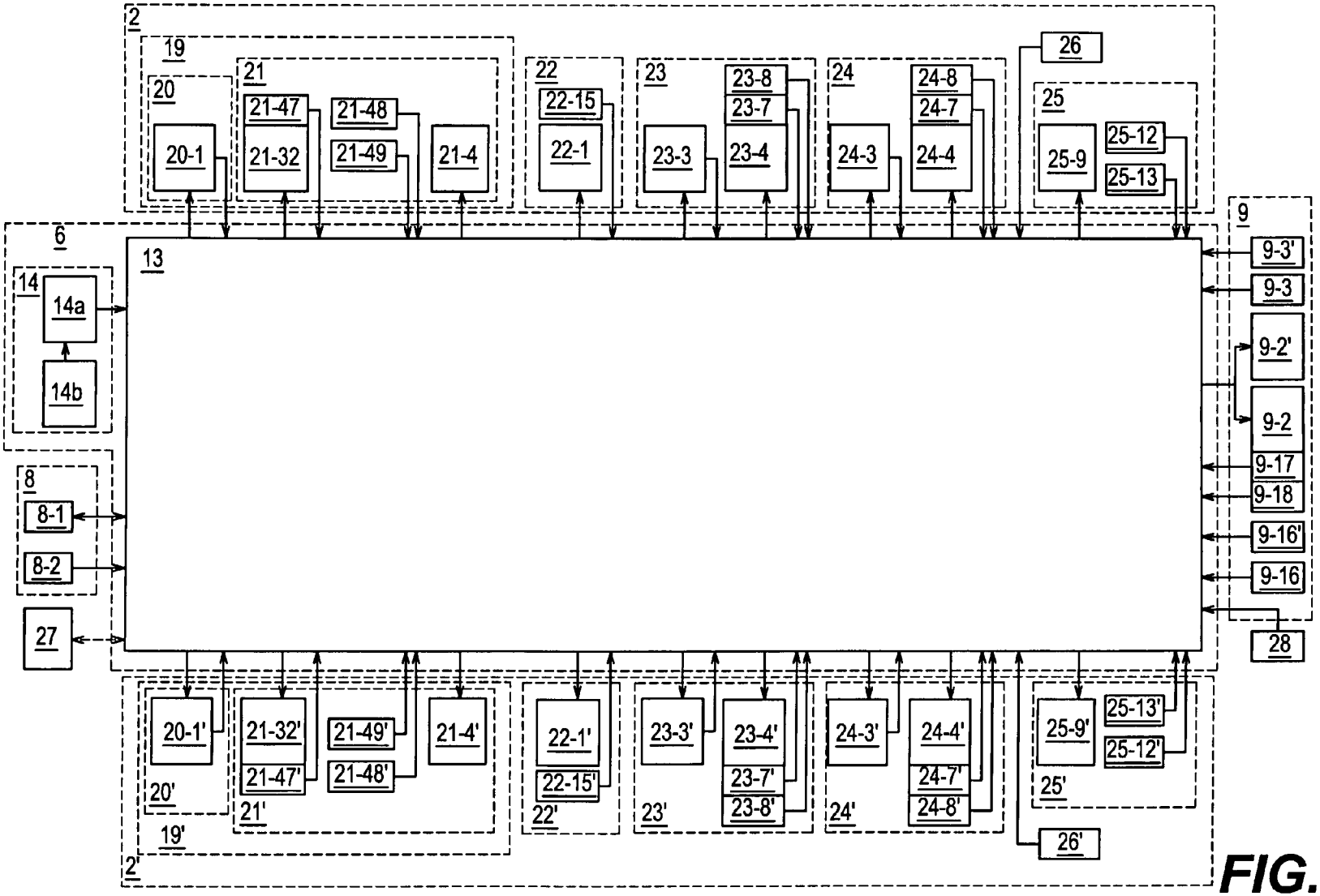
FIG. 15 is a functional schematic diagram of the powered mobile lifting, gait training and omnidirectional rolling apparatus.

For better understanding of general principles of operation and operational relations between elements of the embodiment(s), it is recommended to regularly refer to the functional schematic diagram, FIG. 15.

Referring to FIGS. 1, 2, 3, 4, 5, 6, and 7, the powered mobile lifting, gait training and omnidirectional rolling apparatus generally includes the right carriage 2 and the left carriage 2' which, together with the welded to them crossbar 5 form a rigid 'U'-shaped base that facilitates ingress and egress of the user 1 from a rear side of the apparatus and provides internal clearance necessary for comfortable gait training. The side cover 4 and top cover 3 are bolted to the right carriage 2, and the side cover 4' and top cover 3' are bolted to the left carriage 2'. The crossbar 5 and front cover 6-1 form the power and control compartment 6 which accommodates the motion control and patient monitoring block 13 and power supply block 14 (see FIG. 4) securely mounted on the crossbar 5.

The vertical framework 7 serves as a reinforcement structure, a general safety barrier, a bearing structure for the actuators 9-2 and 9-2' of the powered lifting and supporting device 9 (see FIGS. 5, 6 and 7), and a mounting structure for the top panel 8 equipped with the control panel with a screen 8-1 and the pivoted monitoring camera 8-2. The vertical framework 7 consists of a plurality of welded tubular elements, and it is bolted to the right and left carriages 2 and 2'. The shape of the vertical framework 7 provides the user 1 with a plurality of hand grips.

The height adjustable lifting frame 9-1 (see FIG. 6) of the powered lifting and supporting device 9 is a height adjustable rigid structure consisting of a plurality of tubular members shaped to accommodate the user 1. The lower ends of the frame are pivotally connected to the right carriage 2 and left carriage 2'. The frame tilts back into position ready for user lifting operation and then returns back into its vertical (home) position by means of the right side and left side lifting actuators 9-2 and 9-2'. The top ends of the frame of the powered lifting and supporting device are equipped with the right and left pendulous harness locking mechanisms 9-4 and 9-4'. The powered lifting and supporting device 9 will be described in detail thereinafter in reference to FIGS. 8 and 9.

The user suspension harness 10 is designated to evenly redistribute pressure from body weight and thus, to safely support and suspend a user's body. The user suspension harness 10 is configured for securing about the user's body by means of adjustable thigh wraps 10-1 (see FIG. 6) and an adjustable lumbar belt 10-2 interconnected with a plurality of suspension straps 10-3. Two harness suspension brackets 10-4 are designated to securely connect the suspension harness 10 to the pendulous harness locking mechanisms 9-4 and 9-4' of the powered lifting and supporting device 9, and to prevent user's shoulders from being squeezed by the suspension straps. The patient physiological data acquisition sensors 28 (see FIG. 15) are located on the user suspension harness 10. The above sensors have a common output connector which connects to the mating connector located on the powered lifting and supporting device 9, and they are attached to a user's body when the suspension harness fits on.

The powered omnidirectional wheels with electromechanical brakes 23 and 24, 23' and 24' are joined to and constitute elements of the right and left carriages 2 and 2' correspondingly. The omnidirectional wheels with electromechanical brakes 23 and 24 will be described in more detail thereinafter in reference to FIG. 10.

The right foot and left foot powered gait simulation devices 19 and 19' provide power assisted gait training motion to user's feet which are securely fastened to the above devices. The powered gait simulation devices 19 and 19' will be described in detail thereinafter in reference to FIGS. 10, 11, 12, 13 and 14.

The right and left powered retractable support mechanisms 25 and 25' are introduced to ensure stability of the apparatus and safety of users during lifting and unloading operations. These mechanisms are mounted on and constitute elements of the right and left carriages 2 and 2' correspondingly. Support legs of the retractable support mechanisms are elevated over a floor in retracted position and reach a floor surface in their extended position (see FIGS. 2 and 3). The powered retractable support mechanisms 25 and 25' will be described in detail thereinafter in reference to FIG. 10.

Figure 2:
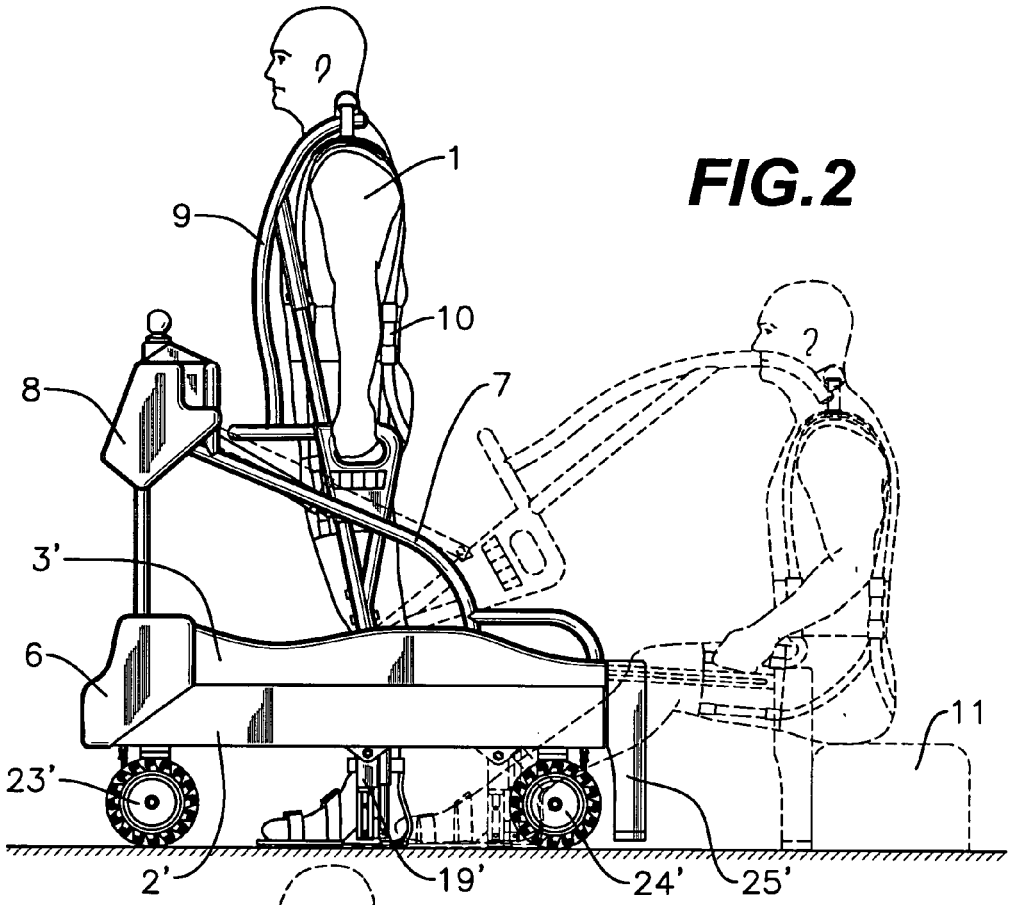
FIG. 2 is a side view of the structure of FIG. 1, and it illustrates a general arrangement of the apparatus and its capability to lift a user from a wide elevated surface.
Figure 3:
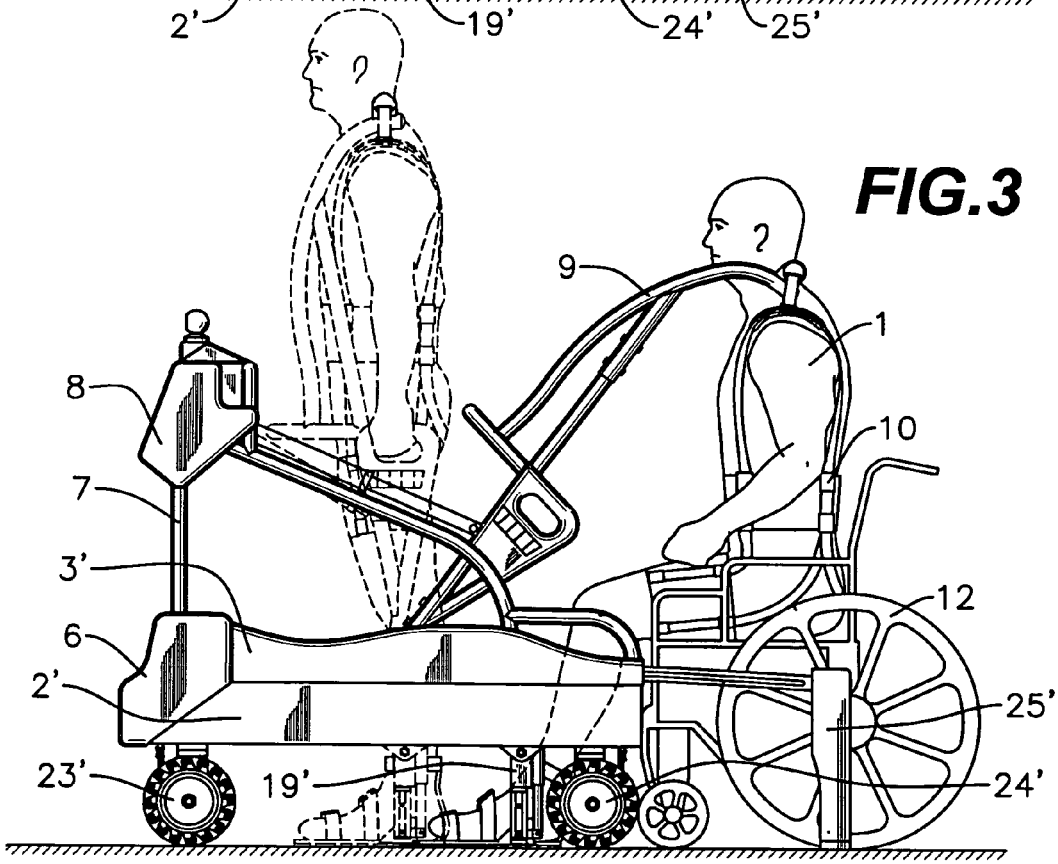
FIG. 3 is a view similar to FIG. 2, and it illustrates a general arrangement of the apparatus and its capability to lift a user from a wheelchair.

Referring to FIGS. 2 and 3, illustrated are capabilities of the powered mobile lifting, gait training and omnidirectional rolling apparatus to lift a user 1 from a wide elevated surface 11 and from a wheelchair 12. In case of lifting from the surface 11, the legs of the powered retractable support mechanisms 25 and 25' extend up to the front vertical surface thus, providing support and stability necessary for lifting operation. In case of lifting from the wheelchair 12, the last is brought into position between legs of the powered retractable support mechanisms 25 and 25' and against the rear side of the apparatus. When the powered retractable support mechanisms 25 and 25' extend, the wheelchair 12 stays inside of the extended structure thus, necessary support and stability necessary for lifting operation is provided. The illustration of the lifting operation from a floor surface is omitted as it is obvious for a skilled artisan that the apparatus is capable to lift a user 1 from a floor surface by further lowering the power lifting and supporting device 9 (see FIG. 2).

Figure 6:
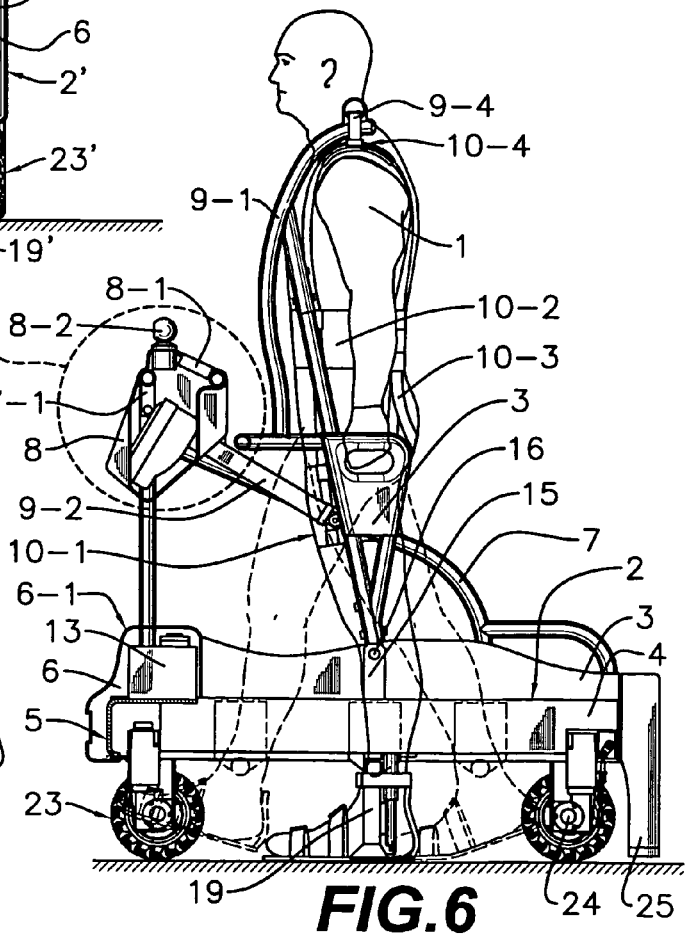
FIG. 6 is a sectional view of the structure of FIG. 4, taken along line 6-6 in FIG. 4. It illustrates a general arrangement of the apparatus, the arrangement of the top panel and power and control compartment, and it also shows user's legs in stand-by, maximum forward and maximum rear positions during walking process. The user is excluded from the section scope.

Referring to FIG. 1 and FIG. 6 which is a sectional view of the FIG. 4 taken along line 6-6 in FIG. 4 (user 1 excluded from the section scope), legs of the user 1 are fastened to and driven by the right foot and left foot powered gait training simulation devices 19 and 19', and they are shown in stand-by, maximum forward and maximum rear positions when move in coordinated manner during power assisted gait training.

Figure 7:
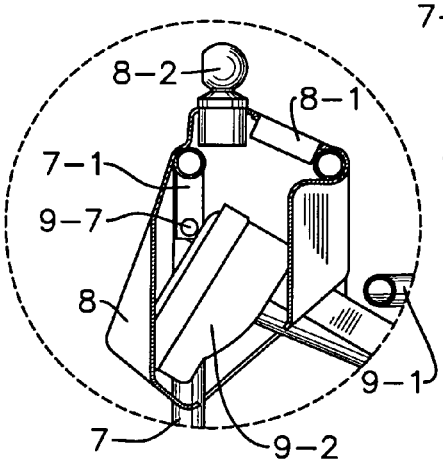
FIG. 7 is an enlarged partial view of the top panel in FIG. 6. It illustrates the arrangement of the top panel and elements connecting actuators of the powered lifting and supporting device to the vertical framework.

Referring to FIG. 7 which is an enlarged partial view of the top panel in FIG. 6, the top panel 8 is bolted to the vertical framework 7. The control panel with a screen 8-1 and the pivoted monitoring camera 8-2 are securely fixed to the top panel 8. The camera 8-2 can pivot in controlled manner about its generally vertical axis to enable remote control over the apparatus. The mounting bracket 7-1 is welded to the top right corner of the vertical framework 7, and it serves to pivotally connect the right side lifting actuator 9-2 by means of the pin 9-7. The arrangement of such elements on the left side of the apparatus is identical.

The structure of the powered lifting and supporting device 9 will now be described in detail.

Figure 8:
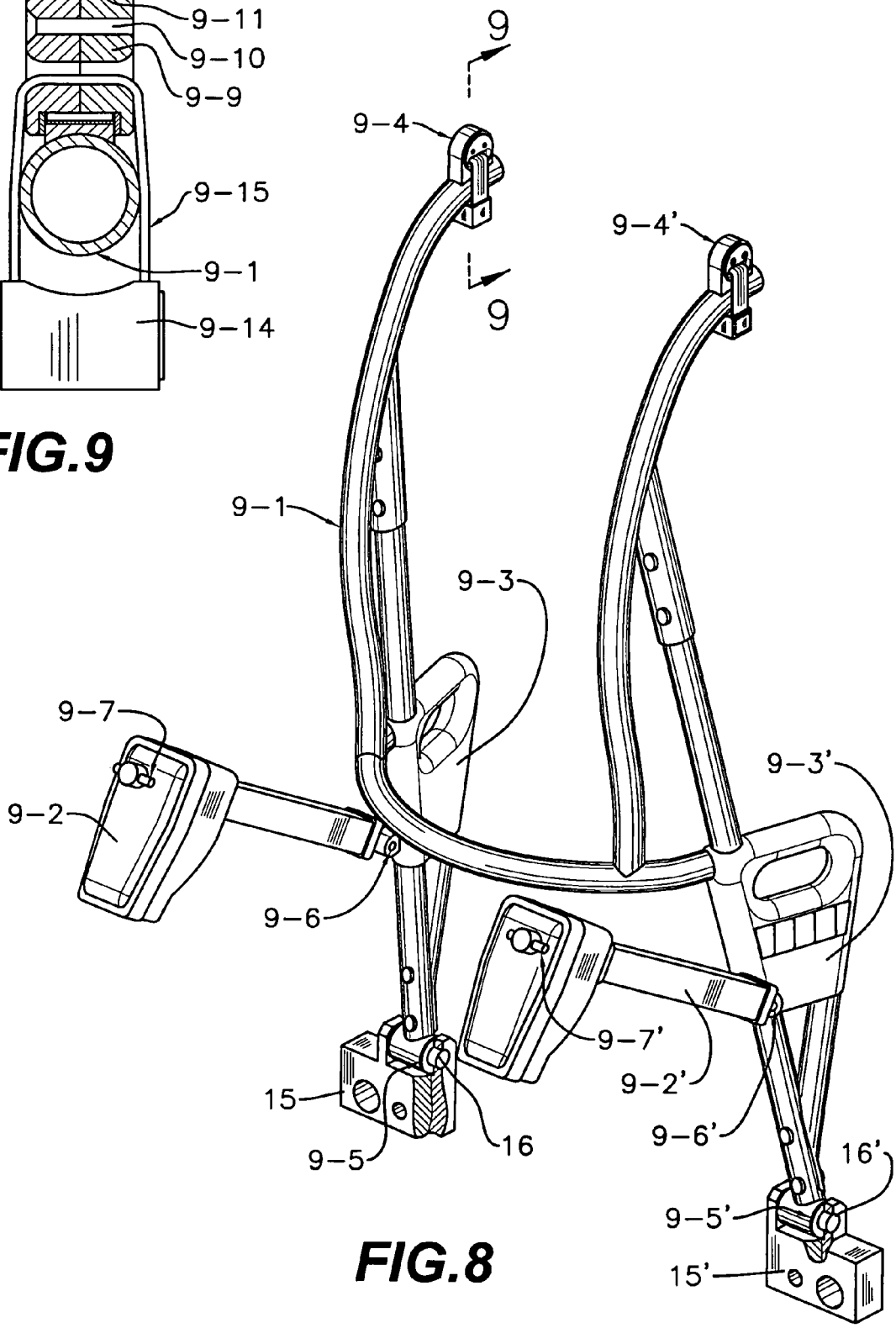
FIG. 8 is an isometric view of the powered lifting and supporting device.

Referring to FIG. 8, the powered lifting and supporting device 9 includes the height adjustable lifting frame 9-1 consisting of a plurality of tubular elements, the right side and left side lifting actuators 9-2 and 9-2', the right side and left side control pads 9-3 and 9-3' combined with hand grips, and the right and left pendulous harness locking mechanisms 9-4 and 9-4'. The height adjustable lifting frame 9-1 is pivotally connected to the mounts 15 and 15' belonging to the right and left carriages 2 and 2' correspondingly, by means of the pins 16 and 16', and bearings 9-5 and 9-5'. The right side and left side lifting actuators 9-2 and 9-2' are pivotally connected to the brackets of the height adjustable lifting frame 9-1 by means of pins 9-6 and 9-6', and to the vertical framework 7 by means of pins 9-7 and 9-7'. The lifting frame home position limit switch 9-17 and lowered position limit switch 9-18 (see FIG. 15) are located on the lifting actuator 9-2 and send information to the motion control and patient monitoring block 13 about reaching home or maximum lowered position by the powered lifting and supporting device 9.

Figure 9:
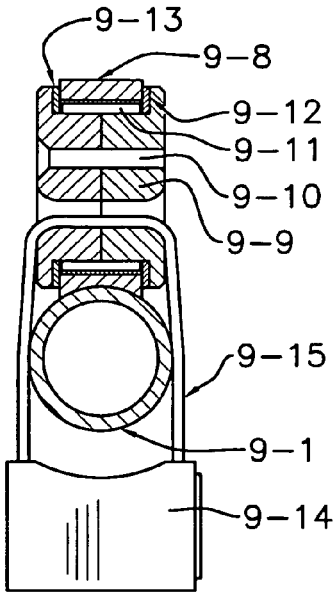
FIG. 9 is an enlarged sectional view of the structure of FIG. 8, taken along line 9-9 in FIG. 8. It illustrates the arrangement of the pendulous harness locking mechanism.

Referring to FIG. 9 which is an enlarged sectional view of the right pendulous harness locking mechanism 9-4 taken along line 9-9 in FIG. 8, the pendulous harness locking mechanism comprises the housing 9-8 welded to the height adjustable lifting frame 9-1, the pivoting strap holder 9-9 consisting of two halves joined by two screws 9-10 and pivotally connected to the housing 9-8 by means of a needle bearing 9-11 and thrust washers 9-12 and 9-13. The pivoting strap holder 9-9 has an opening in its lower part for the pendulous lock strap 9-15 which is securely connected to the latching action pendulous lock 9-14. The pendulous lock accepts and securely locks the harness suspension bracket 10-4 of the user suspension harness 10, and it contains a lock sensor 9-16 (see FIG. 15) which sends information to the motion control and patient monitoring block 13 about presence of the harness bracket in the pendulous lock. The harness release mechanism is actuated by a user 1 from the control pad 9-3 involving a cable link.

The structure of the right carriage 2 will now be described in detail.

Figure 10:
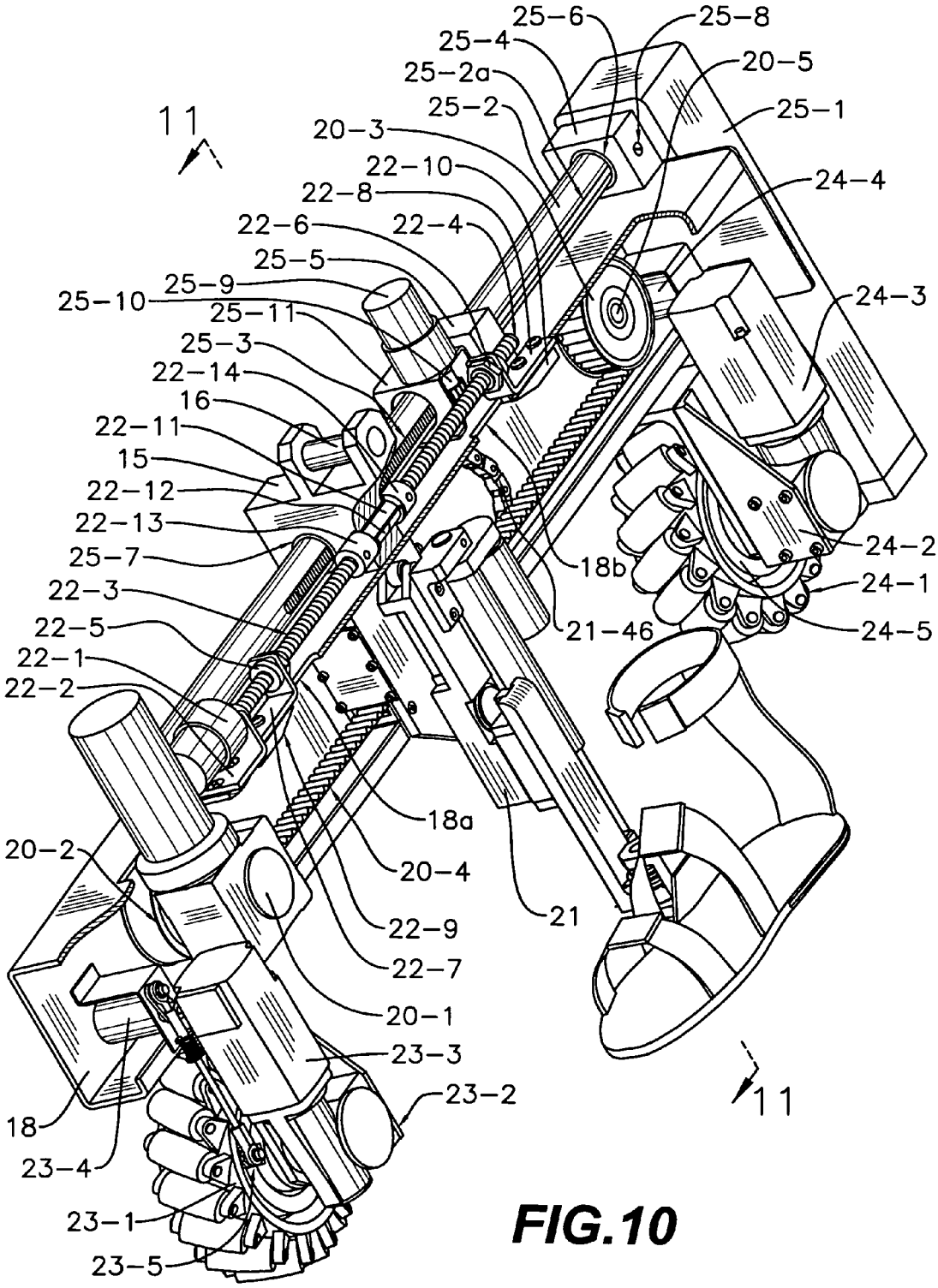
FIG. 10 is a perspective view of the arrangement of the right carriage, with top and side covers removed. It specifically illustrates the arrangement of the right foot step length setup device and right retractable support mechanism, and it provides a general arrangement of the right foot powered gait simulation device and front and rear right powered omnidirectional wheels with electromechanical brakes.
Figure 12:
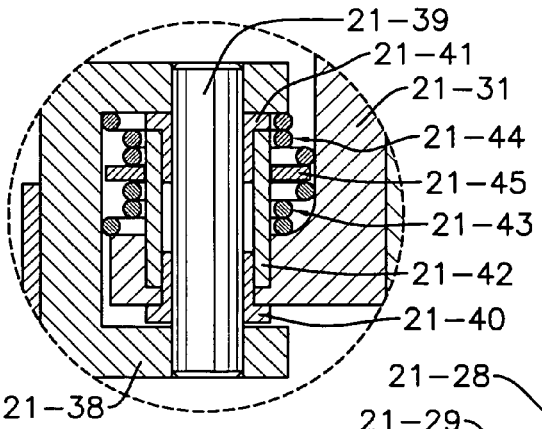
FIG. 12 is an enlarged partial view from FIG. 11. It illustrates the spring loaded pivoting joint of the driving shoe of the powered gait simulation device.

The illustration provided in FIG. 10 is a perspective view of the arrangement of the right carriage 2, with the top cover 3 and side cover 4 (see FIG. 1) removed and with partial cut-out in the right carriage base 18 to enhance understanding of the structure.

Referring to the FIG. 10, the right foot length setup device 22 (see FIG. 15) includes the front and rear length setup cams 22-9 and 22-10 causing pivoting of the right foot slider and vertical motion device 21 which belongs to the right foot powered gait simulation device 19 (see FIG. 1). The above cams are bolted to front and rear cam brackets 22-7 and 22-8, and they can translate forward or backward due to cutouts in their bodies and slotted holes 18*a* and 18*b* in the right carriage base 18. The bracket 22-7 is kinematically linked to the step length setup geared motor 22-1 by means of the securely attached right-hand threaded linear motion nut 22-5 and the right-hand threaded linear motion screw 22-3. The bracket 22-8 is kinematically linked to the step length setup geared motor 22-1 by means of the securely attached left-hand threaded linear motion nut 22-6, the left-hand threaded linear motion screw 22-4, the joint 22-14, the intermediate shaft 22-11, the joint 22-13 and the right-hand threaded linear motion screw 22-3. The step length setup geared motor 22-1 is securely connected to the mounting bracket 22-2 which is bolted to the right carriage base 18. The intermediate shaft 22-11 rotates in two bearings 22-12 installed in the mount 15 and it is kinematically linked to the right-hand threaded linear motion screw 22-3 and the left hand linear motion screw 22-4 by joints 22-13 and 22-14 which also prevent axial translation of the linear motion screws. Rotating of the motor shaft causes either symmetrical widening or narrowing of the span between cams 22-9 and 22-10 depending on the direction of rotation. That increases or decreases the length of travel of the right foot slider and vertical motion device 21 thus, regulating the step length. The step length sensor 22-15 (see FIG. 15) sends feedback information to the motion control and patient monitoring block 13 about the actual length of step.

With continued reference to FIG. 10, the right retractable support mechanism 25 (see FIG. 1) includes the supporting leg 25-1 securely joined with the retractable shaft 25-2 which translates along two linear motion guides 25-6 installed in the mounting blocks 25-4 and 25-5 and along another linear motion guide 25-7 installed in the mount 15. All the above mounting blocks are bolted to the right carriage base 18. The linear motion guide mounting holes in these blocks are made concentric to each other and arranged at such an angle in vertical plane coinciding with axes of the above holes that the shaft 25-2 slopes back down causing the support leg 25-1 to elevate over a floor when the retractable support mechanism 25 is in retracted position, and to reach a floor surface when in extended position (see FIGS. 2 and 3). Rotation of the retractable shaft 25-2 is prevented by means of two opposite longitudinal grooves 25-2*a* made in the shaft and two corresponding guiding pins 25-8 securely installed in the mounting block 25-4 from opposite sides. The shaft 25-2 is kinematically linked to the right carriage retractable support geared motor 25-9 by means of an open rack-and-pinion gear consisting of rack 25-3 securely connected to the shaft 25-2 and the pinion 25-10 securely connected to a shaft of the motor 25-9. The right carriage retractable support geared motor 25-9 is securely attached to the motor mounting bracket 25-11 which, in turn, bolted to the right carriage base 18. The home position limit switch 25-12 and the extended position limit switch 25-13 (see FIG. 15) send information to the motion control and patient monitoring block 13 about reaching home (retracted) or maximum extended position by the right retractable support mechanism 25.

Referring again to FIG. 10, the front right powered omnidirectional wheel with electromechanical brake 23 (see FIG. 1) includes the front right omnidirectional wheel 23-1 rotatably connected to the front right wheel mount 23-2 which is securely fixed to the right carriage base 18. The front right powered omnidirectional wheel with electromechanical brake 23 further includes the front right wheel geared servomotor 23-3 bolted to the wheel mount 23-2 and which shaft is drivingly connected to the omnidirectional wheel 23-1 by means of the driving shaft that rotates in a pair of bearings installed in the hub of the wheel mount 23-2. The front right wheel braking mechanism 23-5 is actuated by the front right wheel braking geared motor 23-4 securely installed on the mounting bracket 23-6 which is securely connected to the right carriage base 18. The arrangement of the rear right powered omnidirectional wheel with electromechanical brake 24 (see FIG. 1) is similar to the arrangement of the front right powered omnidirectional wheel with electromechanical brake 23. The front right and rear right omnidirectional wheels 23-1 and 24-1 are similar but have opposite orientation of rollers; the front right wheel and rear right wheel mounting mechanisms 23-2 and 24-2 have opposite arrangements; the front right wheel and rear right wheel geared servomotors 23-3 and 24-3 are identical; the front right wheel and rear right wheel braking mechanisms 23-5 and 24-5 are identical but have opposite location relatively omnidirectional wheels; the front right wheel and rear right wheel braking geared motors 23-4 and 24-4 are identical, and the mounting brackets 23-6 and 24-6 are identical.

With continued reference to FIG. 10, the right foot powered gait simulation device 19 (see FIG. 1) consists of the right foot translation mechanism 20 (see FIG. 15) and the right foot slider and vertical motion device 21. The right foot translation mechanism 20 is designated for driving the right foot slider and vertical motion device 21 and, therefore, translating user's foot forward or backward. The same includes the geared servomotor 20-1 bolted to the right carriage base 18, the driving sprocket 20-2 securely connected to the shaft of the geared servomotor 20-1, the timing belt 20-4 and the idler sprocket 20-3. The idler sprocket 20-3 is rotatably connected to the hub 20-5 by means of a pair of bearings. The hub 20-5 is securely bolted to the right carriage base 18, however, it is adjustable in horizontal direction before screws tightened to enable installation and tightening of the timing belt. Detailed description of the right foot slider and vertical motion device 21 will further be provided. The flexible cable guide 21-46 houses cables (not shown) connecting electrical components of the right foot slider and vertical motion device 21 with the motion control and patient monitoring block 13 (see FIG. 15).

Referring to the FIGS. 11, 12, 13 and 14, the right foot slider and vertical motion device 21 includes the housing 21-1 connected to the right carriage base 18 by means of the lower and upper linear motion guides 21-2 and 21-3 so that travel blocks of the guides are bolted to the housing 21-1 and rails are bolted to the right carriage base 18 thus, enabling horizontal translation of the housing 21-1. The right foot slider and vertical motion device 21 also includes the side plate 21-19, the front plate 21-17 with securely attached to it liner 21-15, and the rear plate 21-18 with securely attached to it liner 21-16 which are all bolted to the housing 21-1 thus, forming a rigid structure that has openings in its lower and upper portions for the timing belt 20-4 to pass through (see also FIG. 10).

With continued reference to FIGS. 11, 12, 13 and 14, the right foot slider and vertical motion device 21 further includes a belt clutch mechanism which includes the pressure bracket 21-12 that performs clutching action by clutching the timing belt 20-4 between the upper friction pad 21-13 securely connected to the pressure bracket 21-12 and the lower friction pad 21-14 securely connected to the housing 21-1. The pressure bracket 21-12 is guided by the front and rear liners 21-15 and 21-16 during its vertical translation. The same bracket is kinematically linked to the power solenoid 21-4 by means of the mounting block 21-11, the pin 21-10, and the "L"-shaped swing arm 21-6 which is pivotally connected to the stepped mounting shaft 21-7. The end holes of the swing arm 21-6 are slotted; that allows simultaneous pivoting and translating motion of the pin 21-10 and the pin of a plunger of the power solenoid 21-4 relatively the swing arm 21-6 thus, enabling ninety degrees linear motion translation required by the arrangement of the clutch mechanism. The stepped mounting shaft 21-7 is securely joined to the housing 21-1, and the swing arm 21-6 is secured on the shaft with the screw 21-9. When the power solenoid 21-4 energizes, its plunger retracts, the "L"-shaped swing arm 21-6 pivots about the stepped mounting shaft 21-7 and drives down the pressure bracket 21-12 via the pin 21-10 and mounting block 21-11. The pressure bracket 21-12 which is also guided by front and rear liners 21-15 and 21-16, clutches the timing belt 20-4 between its (upper) friction pad 21-13 and the lower friction pad 21-14 securely attached to the housing 21-1. As a result, the timing belt starts translating the housing 21-1 and all elements of the right foot slider and vertical motion device 21 and, correspondingly, user's foot in direction and with speed defined by direction and speed of rotation of the geared servomotor 20-1. When the power solenoid 21-4 de-energizes, its return spring acts on the described above kinematical link and lifts the pressure bracket 21-12 thus, disconnecting the right foot slider and vertical motion device 21 from the timing belt and disabling power translation of the user's foot.

Referring again to the FIGS. 11, 12, 13 and 14, the right foot slider and vertical motion device 21 further includes a foot pivoting mechanism comprising the pivoting arm 21-20 pivotally connected via the needle bearing 21-21 and thrust washers 21-23 and 21-24 to the fixed axle 21-22 which is securely connected to the side plate 21-19 using the nut 21-8. The cam follower 21-28 installed on the top of the pivoting arm 21-20 using the pin 21-29. The foot pivoting mechanism of the right foot slider and vertical motion device 21 also includes flat springs 21-25 and 21-26 securely installed into two parallel grooves 21-20*a* (which also have nest holes for spring eyelets) of the pivoting arm 21-20, and the pin 21-27 securely fixed to the side plate 21-19. The pin 21-27 locates between the flat springs 21-25 and 21-26 and its diameter is slightly larger than distance between the above flat springs. Such arrangement keeps the pivoting arm 21-20 in generally vertical position if no pivoting force applied, and it allows spring loaded pivoting of the above arm about the fixed axle 21-22 in both directions when such a force applied. The reaction force acting from the pin 21-27 trough deflected spring onto the pivoting arm and which tends to return the pivoting arm into its default generally vertical position depends on angular displacement of the pivoting arm and a spring ratio. When the cam follower 21-28 meets the front step setup cam 22-9 or rear step setup cam 22-10 (see FIG. 10), the pivoting arm 21-20 starts cam driven pivoting about the fixed axle 21-22. The shape of the cams 22-9 and 22-10 and distance of translation of the right foot slider and vertical motion device 21 when pivoting occurs are arranged in the way to ensure that a trajectory of a user's foot simulates natural walking pattern. The right foot step position sensor 21-48 (see FIG. 15) installed into the side plate 21-19 and sends a signal to stop the right foot translation mechanism when the right foot slider and vertical motion device 21 reaches preset position relatively to the step setup cam. The pivoting position sensor 21-49 (see FIG. 15) installed into the side plate 21-19 and it sends a signal to actuate the right vertical motion actuator 21-32 of the vertical motion device 21 when the pivoting arm 21-20 reaches preset pivoting angle.

With continued reference to FIGS. 11, 12, 13 and 14, the right foot slider and vertical motion device 21 further includes a vertical motion mechanism comprising the "L"-shaped vertical motion bracket 21-31 connected to the pivoting arm 21-20 by means of the linear motion guide 21-30 in the way that the travel block of the guide is bolted to the lower portion of the pivoting arm 21-20 and the rail is bolted to the vertical motion bracket 21-31 thus, enabling translation of the vertical motion bracket 21-31 relatively to the pivoting arm 21-20. The right vertical motion actuator 21-32 is connected to the pivoting arm 21-20 by means of the pin 21-33 and the upper mount 21-34 bolted to the pivoting arm 21-20 in its upper portion. The right vertical motion actuator 21-32 is also connected to the vertical motion bracket 21-31 by means of the pin 21-35 and the lower mount 21-36 bolted to the vertical motion bracket 21-31. Extending or retraction of the actuator 21-32 causes translation of the vertical motion bracket 21-31 relatively to the pivoting arm 21-20.

Referring again to the FIGS. 11, 12, 13 and 14, the right foot slider and vertical motion device 21 further includes a right foot driving shoe suspension comprising the right foot driving shoe 21-37 pivotally connected to the "L"-shaped vertical motion bracket 21-31 by means of the "U"-shaped pivoting bracket 21-38 securely connected to the base plate of the driving shoe 21-37, the pin 21-39 securely connected to the bracket 21-38 and pivoting in the flanged bearings 21-40 and 21-41 which are installed into the bushing 21-42 which in turn securely joined to the vertical motion bracket 21-31. The pivoting motion is spring loaded and restricted by the torsion springs 21-43 and 21-44 installed onto the bushing 21-42 and separated by the spacer washer 21-45. The above torsion springs are installed in opposite to each other orientation and they are slightly pre-loaded against corresponding surfaces of the vertical motion bracket 21-31 and bracket 21-38 thus, keeping the bracket 21-38 and, correspondingly, the driving shoe 21-37 in default position. The driving shoe 21-37 pivots about generally vertical axis forced by a user's foot or due to forces acting on the driving shoe sole from the floor surface at moment when the apparatus maneuvers and the right foot slider and vertical motion device 21 is in its rear position according to gait training sequence. In such cases either torsion spring 21-43 or 21-44 deflects and tends to return the right foot driving shoe 21-37 into its default position.

Figure 11:
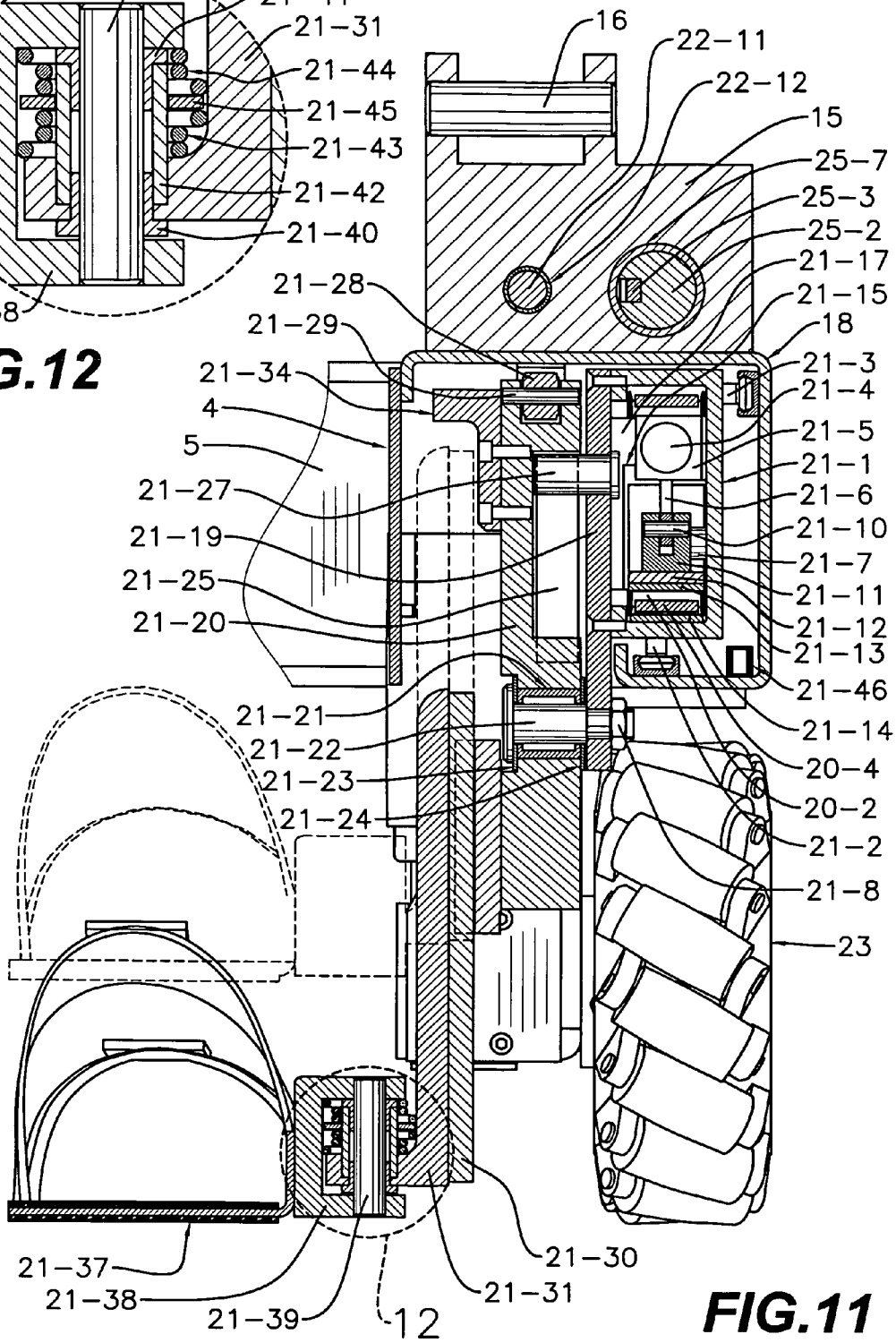
FIG. 11 is a sectional view of the structure of FIG. 10, taken along line 11-11 in FIG. 10. It specifically illustrates the arrangement of the right foot slider and vertical motion device of the right foot powered gait simulation device.
Figures 13, 14:
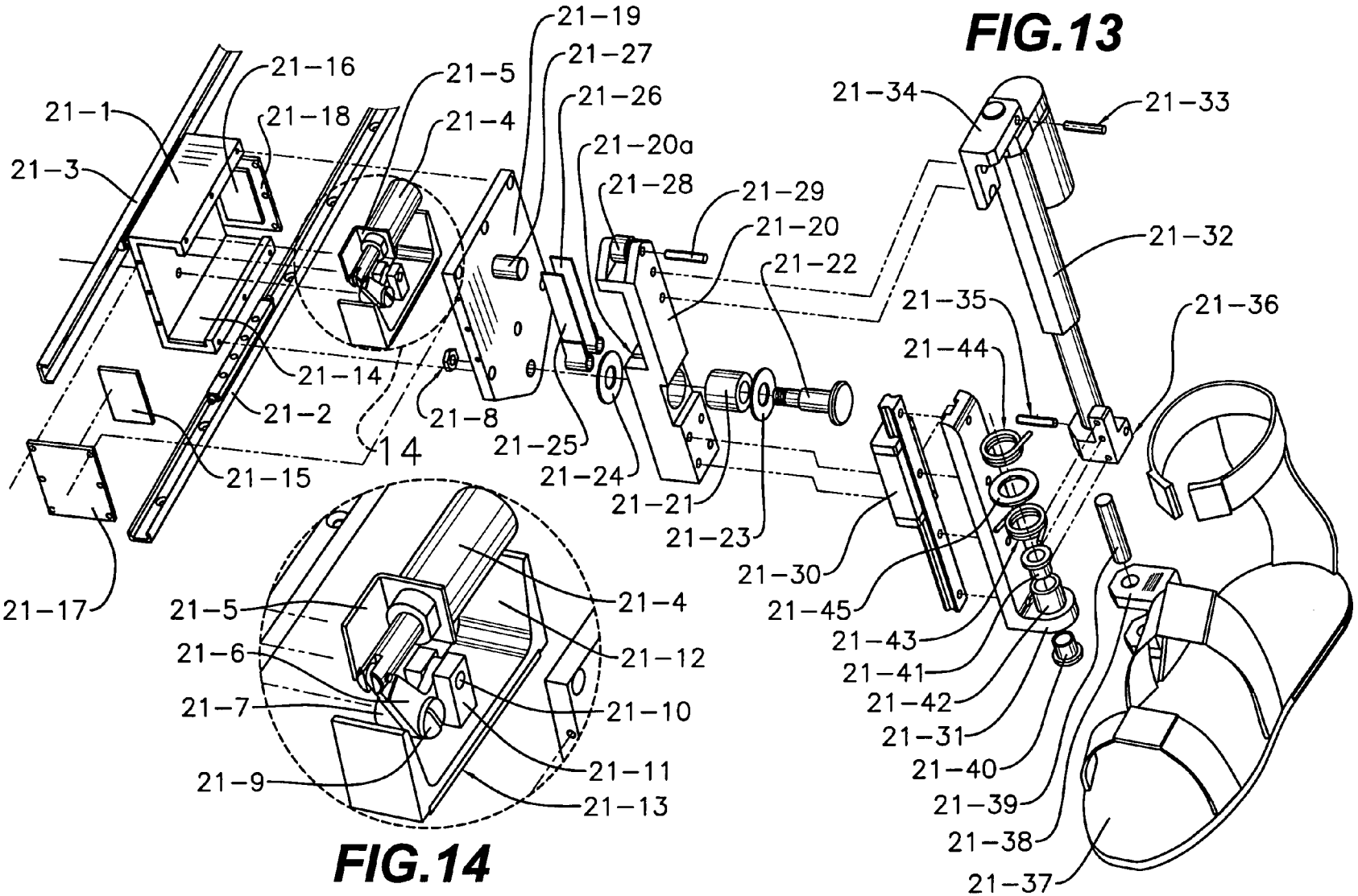
FIG. 13 is a partially exploded view of the right foot slider and vertical motion device of the right foot powered gait simulation device. It is introduced to enhance apprehension of the device.
FIG. 14 is an enlarged partial view from FIG. 13. It illustrates electromechanical belt clutch mechanism of the right foot slider and vertical motion device.

Referring to the FIGS. 11 and 13, the right foot driving shoe 21-37 includes a flexible shoe sole with physical characteristics similar to soles of ordinary walking shoes, with a rigid base plate molded into its rear part. That makes the driving shoe 21-37 rigid at calcaneal region and flexible at metatarsophalangeal and phalangeal regions of a foot similar to ordinary walking shoes. The foot driving shoe 21-37 also includes flexible adjustable foot clamps with locks to fasten the user's foot or foot in a shoe at ankle, tarsal and phalangeal regions. The base plate of the right foot driving shoe 21-37 is securely joined with the pivoting bracket 21-38.

Figure 16:
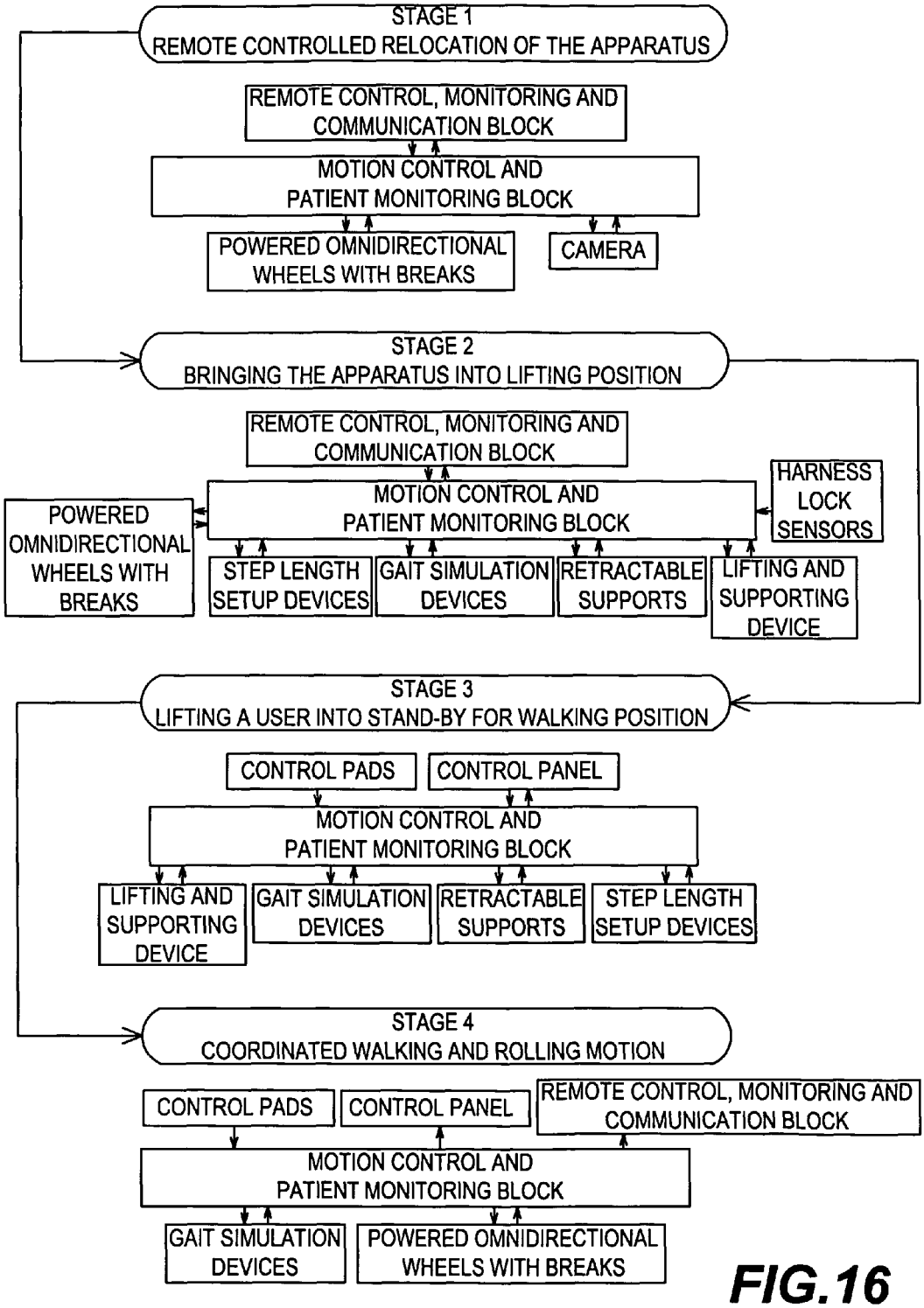
FIG. 16 is a block diagram illustrating the flow of the method of control of the apparatus.

A method of operation of the powered mobile lifting, gait training and omnidirectional rolling apparatus during loading and walking processes and corresponding functional interaction of control and driving means of said apparatus during its operation will now be described in detail referring to FIGS. 15 and 16.

Stage 1—remote controlled relocation of the apparatus. The wireless signals generated by the remote control, monitoring and communication block 27 from user input are received by the motion control and patient monitoring block 13 which further processes them and correspondingly drives the front right wheel geared servomotor 23-3, rear right wheel geared servomotor 24-3, front left wheel geared servomotor 23-3' and rear left wheel geared servomotor 24-3' resulting in translation and (or) maneuvering of the apparatus. The remote commands to engage or release breaks result in simultaneous actuation of the front right wheel brake geared motor 23-4, rear right wheel brake geared motor 24-4, front left wheel brake geared motor 23-4' and rear left wheel brake geared motor 24-4'. The limit switches 23-7, 24-7, 23-7' and 24-7' stop brake motors when breaks are engaged, and the limit switches 23-8, 24-8, 23-8' and 24-8' stop brake motors when breaks are disengaged. The remote operation of the pivoting monitoring camera 8-2 is also carried out from the remote control, monitoring and communication block 27, and the image stream from the camera is transmitted back to the above block to enable user to operate the apparatus which is located remotely, out of user's sight.

Stage 2—bringing the apparatus into ready for lifting position and attaching to the same. The operation is controlled by the remote control, monitoring and communication block 27 through the motion control and patient monitoring block 13. When command is called, the omnidirectional wheel brakes engage; the step length setup geared motors 22-1 and 22-1' with a feedback from the step length sensors 22-15 and 22-15' bring the right foot and left foot step length setup devices 22 and 22' into maximum step length position; the right foot and left foot powered gait simulation devices 19 and 19' bring the driving shoes back; the right carriage and left carriage retractable support geared motors 25-9 and 25-9' extend the right and left retractable support mechanisms 25 and 25' to a user controlled length. Limit switches 25-12, 25-12', 25-13 and 25-13' stop mechanisms in home and fully extended position. Then the user who has previously fit on the suspension harness 10 (see FIG. 1) fastens his (her) feet to the driving shoes of the right foot and left foot powered gait simulation devices 19 and 19' and remotely calls a command to lower the powered lifting and supporting device 9. Simultaneous action of the right side and left side lifting actuators 9-2 and 9-2' bring the height adjustable lifting frame of the powered lifting and supporting device to a user controlled elevation. The override of said lifting frame is prevented by the home position and maximum lowered position limit switches 9-17 and 9-18. Then the user connects and securely locks the suspension harness 10 to the powered lifting and supporting device 9. The left side and right side lock sensors 9-16 and 9-16' send signal to the motion control and patient monitoring block about presence of harness brackets in the right and left pendulous locking mechanisms 9-4 and 9-4'(see FIG. 8) thus, allowing further lifting operation. Also, the user attaches the output connector of patient physiologic data sensors 28 to the corresponding input connector on the powered lifting and supporting device 9.

Stage 3—lifting a user into stand-by for walking position. The user holds the hand grips of the powered lifting and supporting device 9 and simultaneously calls from the left and right side control pad 9-3 or 9-3' (see also FIG. 8) a command to lift and bring him or her into stand-by for walking position. The powered lifting and supporting device 9 moves into its home (vertical) position. Simultaneously, the right foot and left foot powered gait simulation devices 19 and 19' bring the user's feet into stand-by for walking position directly beneath the harness suspension connection points (see FIG. 6) which is sensed by the right and left mid-position sensors 26 and 26', the right foot and left foot step length setup devices 22 and 22' reset to the required length of step, and the right and left retractable support mechanisms 25 and 25' retract to their home position. The user sets from the control panel 8-1 the length of steps and a foot which starts moving first.

Stage 4—coordinated walking and rolling motion. From a stand-by position, motion starts either with the right or left foot by user's choice. Direction and speed of motion is controlled by user input from the left or right side control pad 9-3 or 9-3'. For the following description, the right foot is chosen as starting one and the apparatus performs forward translation. The brake geared motors 23-4, 24-4, 23-4' and 24-4' disengage brakes. The right foot vertical motion actuator 21-32 of the right foot slider and vertical motion device 21 starts elevating the right foot controlled by the right foot elevation position sensor 21-47. The power solenoids 21-4 and 2-4' engage the clutch mechanisms. The geared servomotor 20-1 of the right foot translation mechanism 20 begins translating the right foot forward with controlled velocity, and the geared servomotor 20-1' of the left foot translation mechanism 20' begins translating the left foot backward. Simultaneously, geared servomotors 23-3, 23-4, 23-3' and 24-4' begin driving the omnidirectional wheels. The translation of the apparatus is coordinated with motion of user's feet to provide a natural displacement of user's body and to keep the left foot stationary relative to a floor. When the right foot advances over the point where the cam follower 21-28 (see FIG. 13) of the right foot slider and vertical motion device 21 meets the front step setup cam 22-9 (see FIG. 10) of the right foot length setup device 22, the pivoting arm 21-20 and therefore, the right foot begin pivoting according to the shape of the cam which is calculated to provide a natural walking pattern. The left foot begins pivoting in direction opposite to the right foot when the corresponding cam follower meets the rear step setup cam of the left foot slider and vertical motion device 21', and the left foot simultaneously begins elevating as the left foot vertical motion actuator 21-32' starts retracting triggered by a signal from the pivoting position sensor 21-49'. At this moment driving shoe sole reaches a floor surface and begins flexing similarly to ordinary shoes. Due to flexibility of the driving shoe sole, the foot which is in rear position is naturally shaped so it is not exposed to unusual strains. When the right foot reaches the full step length, the right foot step position sensor 21-48 sends a signal to stop the right and left foot translation mechanisms and to begin extending the right foot vertical motion actuator thus, lowering down the right foot. Also, at this point the left foot which is in its maximum rear position is maximum pivoted and continues elevating (see FIG. 5). At this point, another step begins.

The right foot and left translation mechanisms 20 and 20' reverse their direction of motion. The left foot starts advancing and simultaneously it continues elevating to a point where the left foot elevation position sensor 21-47' sends a signal to stop elevation. In the course of its advancement, the left foot returns into its generally vertical position as the cam follower of the left foot slider and vertical motion device 21' gets off the rear step length setup cam. The left foot in its vertical and fully elevated position continues translating forward and begins pivoting when the cam follower of the left foot slider and vertical motion device 21' meets the front step length setup cam. When the left foot reaches the full step length, the left foot step position sensor 21-48' sends a signal to stop the left foot and right translation mechanisms and to begin extending the left foot vertical motion actuator thus, lowering down the left foot.

At the same moment when the left foot starts advancing, the right foot starts moving backward and continues lowering down until the right foot vertical motion actuator 21-32 (see FIG. 13) is fully extended. In the course of its translation, the right foot returns into its generally vertical position as the cam follower 21-28 (see FIG. 13) of the right foot slider and vertical motion device 21 gets off the front step length setup cam 20-9 (see FIG. 10). The right foot in its vertical and fully lowered position continues translating backward and begins pivoting when the cam follower of the right foot slider and vertical motion device 21 meets the rear step length setup cam 22-10 (see FIG. 10). The right foot also begins elevating as the right foot vertical motion actuator 21-32 starts retracting triggered by a signal from the pivoting position sensor 21-49. At this point driving shoe sole reaches a floor surface and begins flexing similarly to ordinary shoes. When the right foot reaches the maximum rear position, it is maximum pivoted and continues elevating (see FIG. 5). At this point, another walking cycle begins, and so on. The translation of the apparatus is coordinated with motion of feet to provide a natural displacement of user's body and to keep the foot which currently translates backward relatively to the base of the apparatus, stationary relatively to a floor.

Further stages of operation of the apparatus has already been described when disclosing the method in the Technical Solution section.

Patient's physiological data is simultaneously shown on screens of the control panel 8-1 and of the remote control, monitoring and communication block 27.

The power supply block 14 consists of the rechargeable electric power supply source 14*a* and the charging device 14*b*.

Each of the components described above for powered mobile lifting, gait training and omnidirectional rolling apparatus may be made of metals, plastics, ceramics and equivalent materials, as would be apparent to a skilled artisan.

Although particular embodiments of the invention have been described in detail with reference to the accompanying drawings, it is intended that the specification and elements be considered as exemplary only, and it is anticipated that other embodiments of the invention will be apparent to those skilled in the art from consideration of the specification and practice of the invention disclosed herein. It will be understood by those skilled in the art that various changes and modifications may be made by substitution of elements or change of form, proportions, size, location, arrangement or material, without departing from the scope of the invention. Therefore, it is intended that the invention not be limited to the particular embodiments disclosed, but that the invention will include all embodiments falling within the scope of the appended claims.

The invention claimed is:

1. A user operated powered mobile lifting, gait training and omnidirectional rolling apparatus for providing a user, said user is a person with complete loss of motor function in lower limbs, with ability to remotely bring said apparatus to close proximity to himself or herself and into a loading position, ingress and egress said apparatus without assistance of other persons from a floor, an elevated surface which is wider, equal or narrower than a width of the apparatus, or a wheelchair and to move in a user controlled direction in a suspended upright position without assistance of other persons, simultaneously exercising a power assisted gait training applied to feet of the user and coordinated with a power assisted translational movement of said apparatus resulting in a coordinated power assisted translational walking of said user comprising a U-shaped base for providing a main bearing structure for elements of said apparatus and an inner space to accommodate the user comprising a pair of carriages rigidly joined by a cross member and a vertical framework; a powered lifting and supporting device for lifting the user from the floor, the elevated surface or the wheelchair into the suspended upright position, supporting the user in said suspended upright position and lowering the user to the floor, the elevated surface or the wheelchair; a user suspension harness for supporting the user in the suspended upright position during operation of said apparatus; a pair of powered foot driving gait simulation devices for providing the power assisted gait training to user's feet, each comprising a foot translation mechanism, a foot slider and vertical motion device and a step length setup device; a plurality of powered steered omnidirectional wheels with brakes for providing a powered omnidirectional mobility in a controlled direction to said apparatus and restrain said apparatus in a stationary position; a plurality of powered retractable support mechanisms for providing stability of said apparatus during user ingress and egress processes; a power supply block for providing an energy for operation of said apparatus; a user operated means of control and monitoring for providing the user with a control over a remote operation of said apparatus, extracting and retracting of said powered retractable support mechanisms, lifting and lowering of said powered lifting and supporting device, coordinating movement of said powered steered omnidirectional wheels with movement of said powered foot driving devices and for monitoring, and transmitting and recording a physiological data of the user.

2. A powered mobile lifting, gait training and omnidirectional rolling apparatus according to claim 1, wherein said powered lifting and supporting device comprising a height adjustable lifting frame comprising a rigid H-shaped height adjustable structure pivotally connected with its lower ends to said carriages and shaped to accommodate the user; a pair of lifting actuators for driving said lifting frame, said lifting actuators are pivotally connected to said lifting frame and to said vertical framework; a pair of hand grips for providing stability for the user during operation of said apparatus; and a pair of pendulous harness locking mechanisms for attaching to said user suspension harness, said pendulous harness locking mechanisms maintain a generally vertical orientation regardless of the position of said lifting frame.

3. A powered mobile lifting, gait training and omnidirectional rolling apparatus according to claim 1, wherein said user suspension harness comprising an adjustable lumbar belt and thigh wraps for fitting on a user's body; a pair of harness suspension brackets for attaching to said powered lifting and supporting device without assistance of other persons and preventing user's chest and shoulders from getting compressed by said user suspension harness; and a plurality of suspension straps for interconnecting elements of said user suspension harness.

4. A powered mobile lifting, gait training and omnidirectional rolling apparatus according to claim 1, wherein said foot translation mechanism for driving a foot of the user in a generally horizontal direction by means of said foot slider and vertical motion device drivingly connected to a timing belt installed on a plurality of belt sprockets driven by a geared motor.

5. A powered mobile lifting, gait training and omnidirectional rolling apparatus according to claim 1, wherein said foot slider and vertical motion device for driving the user's foot in generally horizontal and vertical directions combined with pivotal movement about a generally horizontal axis, said foot slider and vertical motion device provides the user's foot with a limited spring loaded freedom for pivotal movement about generally vertical and horizontal axes.

6. A powered mobile lifting, gait training and omnidirectional rolling apparatus according to claim 1, wherein said foot slider and vertical motion device comprising a housing for moving the user's foot in a generally horizontal direction and accommodating elements of said foot slider and vertical motion device, said housing slides along said carriages by means of at least one linear motion guide; a belt clutch mechanism for drivingly connecting said foot slider and vertical motion device with said foot translation mechanism; a foot pivoting mechanism for spring loaded pivotal movement of the user's foot about a generally horizontal axis; a vertical motion mechanism for moving the user's foot in a generally vertical direction; and a foot driving shoe suspension for fitting to the user's foot, transmitting driving forces to the user's foot and providing a limited spring loaded freedom for pivotal movement of the user's foot about a generally vertical axis.

7. A powered mobile lifting, gait training and omnidirectional rolling apparatus according to claim 6, wherein said belt clutch mechanism comprising a pressure bracket for pressing against said housing; a power solenoid for driving said pressure bracket by means of a swing arm pivotally connected to said housing; a plurality of liners for guiding said pressure bracket in said housing.

8. A powered mobile lifting, gait training and omnidirectional rolling apparatus according to claim 6, wherein said foot pivoting mechanism comprising a pivoting arm pivotally connected to a fixed axle securely connected to a side plate securely connected to said housing; a cam follower for providing pivoting movement to said pivoting arm, said cam follower securely connected at a top of said pivoting arm; a plurality of springs for keeping said pivoting arm in a generally vertical position when a pivoting force is not applied, returning said pivoting arm in a generally vertical position when the pivoting force removed and providing a spring loaded freedom of pivotal movement of the user's foot about a generally horizontal axis when the pivoting force is not applied.

9. A powered mobile lifting, gait training and omnidirectional rolling apparatus according to claim 6, wherein said vertical motion mechanism comprising a vertical motion bracket connected to said foot pivoting mechanism by means of a linear motion guide; a vertical motion actuator for driving said vertical motion bracket in a generally vertical direction, said vertical motion actuator drivingly connecting said vertical motion bracket to said foot pivoting mechanism.

10. A powered mobile lifting, gait training and omnidirectional rolling apparatus according to claim 6, wherein said foot driving shoe suspension comprising a foot driving shoe comprising a driving shoe sole, a plurality of adjustable foot clamps for fitting to the user's foot and a pivoting bracket securely connected to a base plate securely connected to said driving shoe sole; said pivoting bracket pivotally connected to said vertical motion mechanism for enabling a pivotal movement of said foot driving shoe about a generally vertical axis; a plurality of springs for keeping the user's foot in a natural orientation and to enable a limited spring loaded freedom of a pivotal movement of said foot driving shoe about a generally vertical axis.

11. A powered mobile lifting, gait training and omnidirectional rolling apparatus according to claim 1, wherein said step length setup device comprising a front step length setup cam and a rear step length setup cam for pivoting said foot slider and vertical motion device about a generally horizontal axis and setting limits of a generally horizontal translation of said foot slider and vertical motion device, each of said step length setup cams drivingly connected to a length setup geared motor by means of a linear motion nut and a linear motion screw, said step length setup cams translate in opposite directions when driven by said length setup geared motor thus changing limits of horizontal translation of said foot slider and vertical motion device.

12. A powered mobile lifting, gait training and omnidirectional rolling apparatus according to claim 1, wherein each of said powered steered omnidirectional wheels with electromechanical brakes comprising an omnidirectional wheel drivingly connected to a geared motor by means of a shaft rotatably connected to a wheel mount securely connected to said geared motor, and a braking mechanism kinematically connected to a braking geared motor.

13. A powered mobile lifting, gait training and omnidirectional rolling apparatus according to claim 1, wherein each of said powered retractable support mechanisms comprising a supporting leg securely connected to a retractable non-rotating shaft slidably translating along a plurality of linear motion guides securely connected to each of said carriages; said retractable shaft drivingly connected to a retractable support geared motor by means of an open rack-and-pinion gear and sloped relatively to a floor surface for enabling said supporting leg to elevate over the floor surface in a retracted position and to reach the floor surface in an extended position.

14. A powered mobile lifting, gait training and omnidirectional rolling apparatus according to claim 1, wherein said user operated means of control and monitoring comprising a motion control and patient monitoring block for computerized processing of input data and generating output signals for driving said powered foot driving gait simulation devices in a coordinated manner, driving said powered steered omnidirectional wheels and coordinating their rotation with a movement of the powered foot driving gait simulation devices thus reproducing a natural translational walking of a human, driving said powered lifting and supporting device and said powered retractable support mechanisms, monitoring, recording and transmitting the user's physiological data; a remote control, monitoring and communication block for the remote operation of said apparatus, monitoring the user's physiological data and communicating with the user; a pair of side control pads for operating said apparatus, said side control pads attached to said powered lifting and supporting device; a control panel with a screen for setting and monitoring operation parameters of said apparatus and monitoring the user's physiological data; a pivoted monitoring camera for acquiring visual information about a current positioning of said apparatus to enable the remote operation of said apparatus; a means of positional sensing for acquiring feedback signals about actual current positions of elements of said apparatus comprising a plurality of sensors for sensing a stand-by position of said foot translation mechanism, a plurality of sensors for sensing an elevation of said foot slider and vertical motion device, a plurality of sensors for sensing a position of said foot slider and vertical motion device relatively to said step length setup device, a plurality of sensors for sensing a pivoting of said foot slider and vertical motion device, a plurality of sensors for sensing the length of steps, a plurality of sensors for sensing a connection of said user suspension harness to said powered lifting and supporting device, a plurality of sensors for sensing a home position and a user loading position of said powered lifting and supporting device, a plurality of sensors for sensing the retracted and extended positions of said powered retractable support mechanisms, and a plurality of sensors for sensing a movement and a braking of said powered steered omnidirectional wheels with brakes; and a plurality of sensors for acquiring the physiological data of the user.

15. A method of providing persons with complete loss of motor function in lower limbs with power assisted lifting and power assisted omnidirectional mobility in a user controlled direction coordinated with power assisted gait training to user's feet reproducing a natural translational walking of a user without assistance of other persons employing a powered mobile lifting, gait training and omnidirectional rolling apparatus comprising the steps of providing the powered mobile lifting, gait training and omnidirectional rolling apparatus; fitting a user suspension harness; remotely bringing said apparatus to close proximity to the user by means of a remote control, monitoring and communication block and a pivoted monitoring camera; carrying out a sequence of lifting preparation operations including engaging brakes of a plurality of steered omnidirectional wheels, extending a plurality of retractable support mechanisms, translating a pair of powered foot driving devices in their rear position, fitting said powered foot driving devices to feet of the user, lowering a powered lifting and supporting device into a lifting position, and attaching said user suspension harness to said powered lifting and supporting device; carrying out a sequence of operations of lifting the user from a floor, an elevated surface of any width or a wheelchair into a stand-by for walking position including returning said powered lifting and supporting device into its default generally vertical position with simultaneous coordinated translating of said powered foot driving gait simulation devices into their stand-by position generally under user's torso, setting said powered foot driving gait simulation devices to a user defined length of step, retracting said retractable support mechanisms, and releasing brakes of said steered omnidirectional wheels; power assisted translational walking of the user in a desired direction by coordinated operation of said powered steered omnidirectional wheels and said powered foot driving devices thus resulting in reproducing the natural translational walking of a human, with a user controlled direction and a speed; carrying out a sequence of operations of lowering the user to the floor, the elevated surface or the wheelchair including engaging brakes of said steered omnidirectional wheels, translating said powered foot driving gait simulation devices into their stand-by position generally under user's torso, extending said retractable support mechanisms, lowering said powered lifting and supporting device into the lifting position with simultaneous coordinated translating of said powered foot driving gait simulation devices into their rear position, detaching the user suspension harness from the powered lifting and supporting device, and detaching said powered foot driving devices from the user's feet.

* * * * *